US009893428B2

(12) United States Patent
Elad et al.

(10) Patent No.: US 9,893,428 B2
(45) **Date of Patent: *Feb. 13, 2018**

(54) DIRECT TRANSITION FROM A WAVEGUIDE TO A BURIED CHIP

(71) Applicant: SEMICONDUCTOR COMPONENTS INDUSTRIES, LLC, Phoenix, AZ (US)

(72) Inventors: Danny Elad, Moshav Liman (IL); Noam Kaminski, Kiryat Tivon (IL); Ofer Markish, Nesher (IL)

(73) Assignee: Semiconductor Components Industries, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/606,756

(22) Filed: May 26, 2017

(65) Prior Publication Data

US 2017/0271775 A1 Sep. 21, 2017

Related U.S. Application Data

(63) Continuation of application No. 14/964,689, filed on Dec. 10, 2015, now Pat. No. 9,692,135.

(51) Int. Cl.

| | |
|---|---|
| ***H01Q 13/00*** | (2006.01) |
| ***H01P 3/12*** | (2006.01) |
| ***H01P 3/16*** | (2006.01) |
| ***H01P 5/08*** | (2006.01) |
| ***H01P 5/107*** | (2006.01) |
| ***H01Q 1/50*** | (2006.01) |
| ***H01Q 15/14*** | (2006.01) |
| ***H01Q 19/10*** | (2006.01) |

(Continued)

(52) U.S. Cl.

CPC ..... *H01Q 13/00* (2013.01); *H01P 3/12* (2013.01); *H01P 3/16* (2013.01); *H01P 5/08* (2013.01); *H01P 5/107* (2013.01); *H01Q 1/50* (2013.01); *H01Q 13/02* (2013.01); *H01Q 13/0283* (2013.01); *H01Q 15/141* (2013.01); *H01Q 19/10* (2013.01); *H01Q 19/30* (2013.01)

(58) Field of Classification Search

CPC ..... H01Q 1/50; H01Q 19/10; H01Q 19/30; H01P 3/12; H01P 3/16; H01P 5/00; H01P 5/08; H01P 5/107; H01P 11/00

See application file for complete search history.

(56) References Cited

U.S. PATENT DOCUMENTS 7,372,120 B1 5/2008 Towle et al.
7,439,822 B2 10/2008 Shimura et al.

(Continued)

*Primary Examiner* — Hoang Nguyen

(74) *Attorney, Agent, or Firm* — Ramey & Schwaller, LLP

(57) ABSTRACT

An assembly for confining electromagnetic radiation in a waveguide. The assembly comprises a waveguide, comprising walls surrounding a cavity and an aperture in the walls that opens to the cavity, and a substrate assembly disposed in the aperture. The substrate assembly comprises a substrate comprising an antenna, wherein the antenna is located within the cavity and is configured for transmission of radiation within the cavity. The substrate assembly comprises an integrated circuit (IC) electrically connected to the substrate, where the IC comprises semi-conductor components and a ground plane on one side of the IC. The ground plane is located between the IC semi-conductor components and the antenna. The ground plane is located across the aperture to reduce the area of the aperture and to reflect some of the radiation directed to the aperture back into the cavity.

18 Claims, 6 Drawing Sheets

(51) Int. Cl.
*H01Q 19/30* (2006.01)
*H01Q 13/02* (2006.01)

(56) References Cited

U.S. PATENT DOCUMENTS

| | | | |
|---|---|---|---|
| 8,901,719 | B2 | 12/2014 | Ligander |
| 2011/0102284 | A1 | 5/2011 | Brown et al. |
| 2013/0075904 | A1 | 3/2013 | Cho et al. |
| 2013/0256849 | A1 | 10/2013 | Danny et al. |
| 2014/0320231 | A1 | 10/2014 | Seler et al. |
| 2015/0295307 | A1 | 10/2015 | Cook et al. |

DIRECT TRANSITION FROM A WAVEGUIDE TO A BURIED CHIP

CROSS-REFERENCE TO RELATED APPLICATION

The present application is a continuation application of pending U.S. application Ser. No. 14/964,689, filed on Dec. 10, 2015, titled "DIRECT TRANSITION FROM A WAVEGUIDE TO A BURIED CHIP" by inventors Danny ELAD, Noam KAMINSKI and Ofer MARKISH, and hereby incorporated herein by reference, and priority thereto for common subject matter is hereby claimed.

BACKGROUND

The invention relates to the field of waveguides and integrated circuits.

Electromagnetic waves propagate as spherical waves and expand in all directions. The wave amplitude decreases as the inverse square of the distance, such as in the inverse square law. A waveguide may confine the wave to propagate in one dimension, allowing, under ideal conditions, that the wave does not lose power when propagating. The reflection at the waveguide walls confines the waves to the interior of the waveguide. Therefore, the propagation of the wave in the waveguide may be compared to a zigzag path of a rubber ball bouncing off the waveguide walls. For a hollow metal waveguide with a rectangular or circular cross-section, the electromagnetic wave propagation may be very efficient.

The electronic signals that cause the transmission and reception of the electromagnetic waves are typically produced by integrated circuits (ICs), such as chips, and transmission lines typically connect between the ICs and the waveguides.

For example, on-chip systems operating at the millimeter wavelength and/or terahertz frequencies often use an interconnecting circuit between the integrated circuit (IC), such as a chip, and other parts of the system that may be mainly metallic, such as waveguides antennas, and the/or like. For example, typical chip to waveguide transitions require communicating through a transmission line (TL), such as provided on a printed circuit board (PCB), which may result in connection losses between the IC, TL, and/or PCB. As used herein, the term microwave means electromagnetic radiation and/or a conducted alternating current/voltage signal at a frequency of a millimeter wavelength or up to a terahertz frequency, such as between 1 and 1000 gigahertz frequency.

The foregoing examples of the related art and limitations related therewith are intended to be illustrative and not exclusive. Other limitations of the related art will become apparent to those of skill in the art upon a reading of the specification and a study of the figures.

SUMMARY

The following embodiments and aspects thereof are described and illustrated in conjunction with systems, tools, and methods which are meant to be exemplary and illustrative, not limiting in scope.

There is provided, in accordance with some embodiments, an assembly for confining electromagnetic radiation in a waveguide. The assembly comprises an electromagnetic waveguide (EW) comprising walls surrounding a cavity, where the walls have an aperture that opens to the cavity. The assembly comprises a substrate assembly disposed in the aperture. The substrate assembly comprises a substrate comprising an antenna, wherein the antenna is located within the cavity and is configured for transmission of electromagnetic radiation within the cavity. The substrate assembly comprises an integrated circuit (IC) electrically connected to the substrate, where the IC comprises semiconductor components and a ground plane on one side of the IC. The ground plane is located between the IC semiconductor components and the antenna. The ground plane is located across the aperture to reduce the area of the aperture and to reflect some of the electromagnetic radiation transmitted from the antenna directed to the aperture back into the cavity. In some embodiments, the antenna comprises a first transceiving conductor electrically connected to the IC, where the first transceiving conductor comprises one or more recess configured to decrease resonances within the cavity from electromagnetic radiation emanating from the first transceiving conductor, and a second transceiving conductor electrically isolated from the IC to increase the bandwidth of the electromagnetic radiation emanating from the first transceiving conductor. In some embodiments, the first transceiving conductor is a C-shape slotted conductor patch.

In some embodiments, the first transceiving conductor is an E-shape slotted conductor patch.

In some embodiments, the integrated circuit is electrically connected to the substrate with a controlled collapse chip connection (flip chip).

In some embodiments, the antenna is metallic layers embedded in the substrate.

The assembly of claim 1, wherein the antenna is embedded in the substrate and the antenna is constructed as a separate component from the substrate.

In some embodiments, the antenna is a surface mount component electrically connected to the substrate.

In some embodiments, the substrate is electrically connected to a printed circuit board with a flexible printed circuit board.

In some embodiments, the substrate is electrically connected to a printed circuit board with a connector.

In some embodiments, the substrate is electrically connected to a printed circuit board with a direct solder connection and the IC is an active embedded component in the substrate.

In some embodiments, the substrate comprises two or more vias arranged across some of the aperture thereby reflecting some of the electromagnetic radiation from the antenna directed towards the aperture back towards the cavity.

In some embodiments, a ground plane of the substrate is located across the aperture to reduce the area of the aperture by at least 50% thereby reflecting some of the electromagnetic radiation from the antenna towards the cavity.

There is provided, in accordance with some embodiments, an antenna for confining electromagnetic radiation in a waveguide. The antenna comprises a first transmitting conductor comprising one or more recess configured to decrease resonances within an electromagnetic waveguide, where the first transmitting conductor is configured to electrically connect to transceiver electronics. When the transceiver electronics send an electronic signal to the first transmitting conductor, an electromagnetic radiation is transmitted from the first transmitting conductor. The antenna comprises a second transmitting conductor electrically isolated from the electromagnetic waveguide and the transceiver electrics, positioned parallel to the first transmitting conductor to increase a bandwidth of the electromagnetic radiation.

In some embodiments, the first transmitting conductor is a C-shape slotted conductor patch comprising one recess.

In some embodiments, the first transmitting conductor is an E-shape slotted conductor patch comprising two recesses.

In some embodiments, the antenna is embedded in a substrate.

In some embodiments, the antenna is surface mount component electrically connected to a substrate.

There is provided, in accordance with some embodiments, a manufacturing method for electromagnetic coupling between an integrated circuit and an electromagnetic waveguide. The method comprises an action preparing a substrate comprising an antenna. The method comprises an action of attaching an integrated circuit to the substrate using a controlled collapse chip connection. The IC comprises electronic components and a grounding plane. The attaching positions the ground plane between the electronic components and the antenna, thereby producing a substrate assembly. The method comprises an action of attaching the substrate assembly to an electromagnetic waveguide (EW), such that an aperture in the EW receives the substrate, the antenna is located within the EW, and the grounding plane of the IC is located across the aperture to reduce the area of the aperture and to prevent some of the electromagnetic radiation from leaving the EW.

In some embodiments, the antenna comprises a first transceiving conductor electrically connected to some of the electronic components using a via of the substrate and a second transceiving conductor electrically isolated from the electronic components.

In addition to the exemplary aspects and embodiments described above, further aspects and embodiments will become apparent by reference to the figures and by study of the following detailed description.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

Provided herein are methods, devices, and assemblies for direct electromagnetic transmission between an IC and a waveguide. These present significantly reduced transmission losses and improved production simplicity. By preparing a dedicated substrate assembly comprising an IC and a substrate, where the substrate may incorporate an antenna for transceiving an electromagnetic radiation in a waveguide, and preparing an aperture in the waveguide walls for accepting the substrate assembly, the connection losses between the transceiver electronics in the IC and the electromagnetic radiation in the wave guide can be reduced, and confine the electromagnetic radiation within the waveguide. The substrate assembly disposed in the aperture uses a ground plane designed in the IC to reduce the area of the electromagnetic radiation-transparent aperture, increasing the waveguide efficiency. The assembly may be considered a chip burying method that allows reducing the distance and transmission path length between the IC components and the waveguide cavity. The IC may be electrically connected to the substrate using a controlled collapse chip connection ("flip chip") method.

A ground plane designed in the IC and/or substrate structure may be aligned with the waveguide walls, surrounding the cavity, and used to confine the radiation and minimize losses of the electromagnetic radiation leaving the cavity. The compactness of embodiments of the proposed solutions allows the inclusion of several transmission lines and/or transceivers on the same IC. Present embodiments may improve the performance in transceiver applications in the fields of communication, radar, spectroscopy, imaging, and like systems that requires IC to waveguide interconnects.

Optionally, the substrate comprises an array of vias, which reflect the electromagnetic radiation originating from the waveguide cavity back into the cavity thus reducing waveguide losses.

Figure 1:
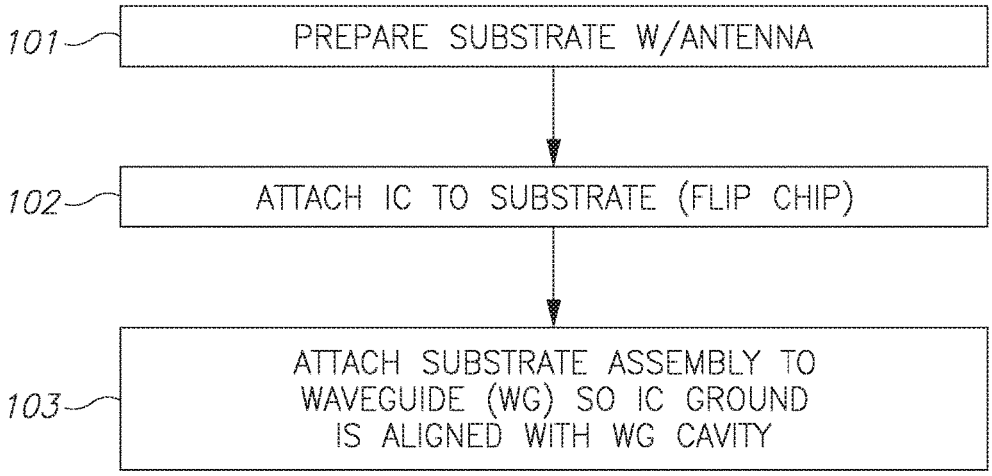
FIG. 1 is a manufacturing method flowchart of an integrated circuit and waveguide assembly for compact microwave transceiving, according to some embodiments of the present invention.

Reference is now made to FIG. 1, which is a manufacturing method flowchart of an integrated circuit and waveguide assembly for compact microwave transceiving, according to some embodiments of the present invention. A substrate may be prepared 101 for attaching 102 an IC, such as a substrate comprising an embedded antenna, a surface mount antenna, and/or the like. The substrate may be prepared with embedded passive components. The substrate may be prepared with flip chip landing pads, multiple layers and electric routing patterns, wire bonding pads, header connecting pads, and/or the like. The IC may be attached to the substrate using a controlled collapse chip connection (flip chip) method and/or the like, creating a substrate assembly. The substrate assembly may be attached 103 to the waveguide by inserting the assembly into an aperture of the waveguide walls so that the ground plane of the IC may be substantially aligned with the walls of the waveguide, thereby confining the electromagnetic radiation in the waveguide. The substrate antenna may be positioned within the waveguide cavity.

Optionally, the substrate assembly is first attached to a PCB, such as using a header, a Joint Test Action Group header, a connector, a socket, wire bonding, and the/or like, and then the waveguide is also attached. Optionally, the IC is an embedded active component in the substrate and the substrate is surface mounted on the PCB. Optionally, both the antenna and IC are embedded in the substrate. For example, the IC and/or antenna are embedded in a substrate as described by Brizoux el al. "Industrial PCB Development using Embedded Passive & Active Discrete Chips Focused on Process and DfR", Proceedings of IPC APEX Conference, Las Vegas, USA, April 2010.

Optionally, the ground plane aligned with the walls of the waveguide is a conducting layer of the substrate. Optionally, a conducting layer of the substrate, a conducting layer of the IC, and/or the waveguide are electrically connected, such as by a solder connection, a wire connection, a thermal bonding connection, a direct contact connection, and the/or like.

Regardless of the ground plane being part of the IC, substrate or a combination of these, the IC ground plane is located across the aperture and confines the electromagnetic radiation within the waveguide cavity. For example, the ground plane reduces the area of the aperture by at least 50%, and reflects some of the electromagnetic radiation directed from the antenna towards the aperture back into the waveguide cavity. Reducing the area of the aperture prevents at least some of the electromagnetic radiation from leaving the waveguide. For example, the ground plane reduces the area of the aperture by at least 60%, by at least 75%, by at least 90%, by at least 95%, and the like, and reflects almost all of the electromagnetic radiation directed from the antenna towards the aperture back into the waveguide cavity. For example, the ground plane reduces the area of the aperture by at least 99%, and reflects substantially all of the electromagnetic radiation directed from the antenna towards the aperture back into the waveguide cavity.

Optionally, the ground plane reduces the area of the aperture by between 10% and 100%, and reflects at least some the electromagnetic radiation directed from the antenna towards the aperture back into the waveguide cavity. The range of values is a range of feasible values, and it is understood that any sub-range of this range are also feasible values. It is understood that the any intermediate value, partial sub-range, of one sided range, such as less than or greater than a specific value, are also feasible values.

Figure 2:
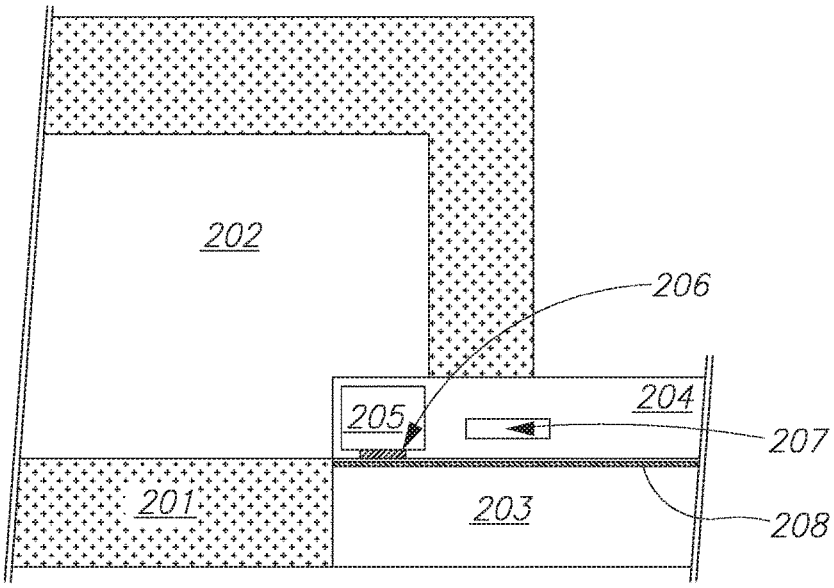
FIG. 2 is a schematic illustration of an integrated circuit and waveguide assembly for compact microwave transceiving, according to some embodiments of the present invention.

Reference is now made to FIG. 2, which is a schematic illustration of an integrated circuit 203 and waveguide 201 assembly for compact microwave transceiving, according to some embodiments of the present invention. A waveguide 201 comprising walls includes a cavity 202 for directing the propagation of electromagnetic radiation and an aperture for receiving a substrate assembly. The substrate assembly comprises a substrate 204 and an IC 203. The electromagnetic radiation may be produced from an antenna 205 that may be embedded in or mounted on a substrate 204. An electrical connection 206, such as a via, a solder bump, and the/or like, between antenna 205 and IC 203 may allow electromagnetic energy in IC 203 to be transferred directly to waveguide cavity 202 using antenna 205. For example, antenna 205 on/in substrate 204 may be any type of a metallic, printed radiating element configured to emit electromagnetic radiation into cavity 202 of waveguide 201.

IC 203 may be located at the edge of waveguide 201 and therefore may be referred to as a "buried chip". IC 203 and waveguide 201 are aligned so a ground plane 208 of IC 203 may be co-planar or substantially co-planar with waveguide 201 walls defining cavity 202. Thus the electromagnetic radiation from antenna 205 may be reflected back from ground plane 208 in a similar manner to being bounced back from waveguide 201 walls, thus reducing waveguide 201 losses. For example, electromagnetic radiation losses from IC 203, doped layers of IC 203, metal layers of IC 203, and the/or like, will not affect waveguide losses since the electromagnetic radiation does not propagate beneath ground layer 208 of IC 203. IC 203 and waveguide 201 interconnection may be very closely coupled, and thus uses a small area of IC 203 with higher efficiency than when using a transmission line between IC 203 and antenna 205. Furthermore, when integrating IC 203 into a waveguide assembly, complicated chip thinning and metal density lowering steps are not needed for assembly.

Figure 3:
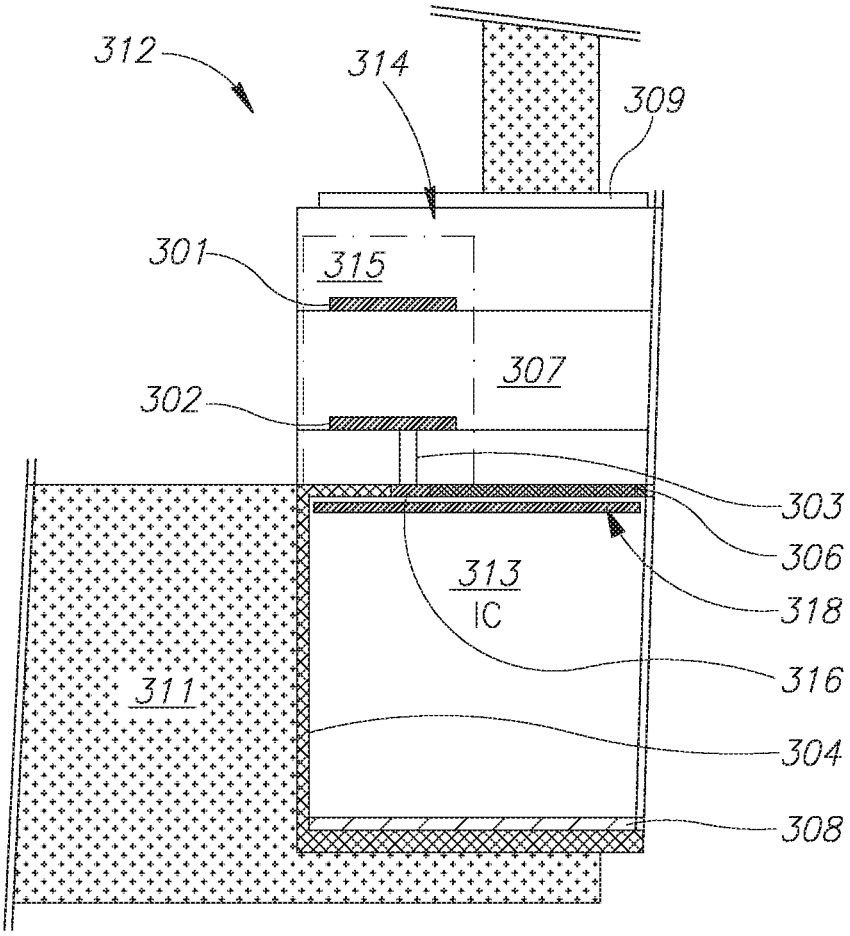
FIG. 3 is a schematic illustration of waveguide assembly details for compact microwave transceiving, according to some embodiments of the present invention.

Reference is now made to FIG. 3, which is a schematic illustration of waveguide assembly details for compact microwave transceiving, according to some embodiments of the present invention. Between a waveguide 311 and IC 313 there may be a gap 304, and ground plane 318 may be approximately aligned with waveguide 311 walls and cavity 312. A thermal conductive adhesive layer 309 may be used to attach substrate 315 to waveguide 311, and a viscous material layer 308 may be used between IC 313 and waveguide 311 for stress relief. Substrate 311 may comprise multiple substrate layers 307, where between some layers one or more conductors may be applied using printed circuit board technologies, such as an electrically isolated conductor 301 and/or an electrically connected conductor 302.

Electrically connected conductor 302 may be electrically connected to IC 313 using an electrically conducting material, such as a solder bump 316 and the/or like, and/or a via 303 of substrate 314. Optionally, conductor 302 may be electrically connected to IC 313 using non-galvanic connections, such as aperture coupling, proximity coupling, etc. Electrically isolated conductor 301 and/or electrically connected conductor 302 may be components of electromagnetic radiation antenna 315. For example, antenna 315 is a slotted, stacked-patch microstrip antenna embedded in substrate 314 that emits electromagnetic radiation inside waveguide 311. Optionally, antenna 315 is a surface-mounted component electrically connected to substrate 314, and electrically connected to IC 313, optionally using vias in substrate 314. The slotted design of antenna 315 avoids resonance effects from positioning antenna 315 at a side of waveguide 311 walls and cavity 312 instead of the middle of an end wall of waveguide 311. The slotted patch antenna may be a "C-shaped" patch antenna, an "E-shaped" patch antenna, and the/or like.

The term "C-shaped" patch antenna, as referred to herein, may relate to a radiating conductor, such as a metal layer in the substrate, that is substantially aligned in a plane parallel to a wall of the waveguide and having a thickness perpendicular to the plane of between 1 micrometer and 1 millimeter. The radiating conductor is an open loop of conducting material with a substantially square, rectangular, circular, or the like, outline, comprising a recess concentric with the outline, and the conducting loop between the recess and the outline for substantially 50% to 95% of the perimeter of the space between the recess and the outline. The radiating conductor is isolated from the waveguide and positioned within the waveguide cavity. The open end of the conductor, such as the missing 5% to 50% of the perimeter, may be open towards a wall of the waveguide.

The term "E-shaped" patch antenna, as referred to herein, may relate to a radiating conductor shaped similar to the C-shaped antenna, with the addition of a central conductor starting from the side opposite the loop opening, such as the opposite the missing 5% to 50% of the perimeter, extending towards the loop opening, and ending at least in the center of the outline.

An analog or digital transmission line 306 may be used to transfer respective type signals to IC 313 and/or antenna 315. Transmission line 306 may be located between IC 313 and substrate 314, within IC 313, within substrate 314, or a combination of these. Electromagnetic frequency signals may transceived on transmission line 306 from IC 313 or from an external signal generator. Substrate 314 may be a multi-layer electronic package technology material, such as low temperature co-fired ceramics, glass-reinforced epoxy laminate (FR-4), PCB, sequential build-up (SBU) laminate substrate, and the/or like.

Figure 4A:
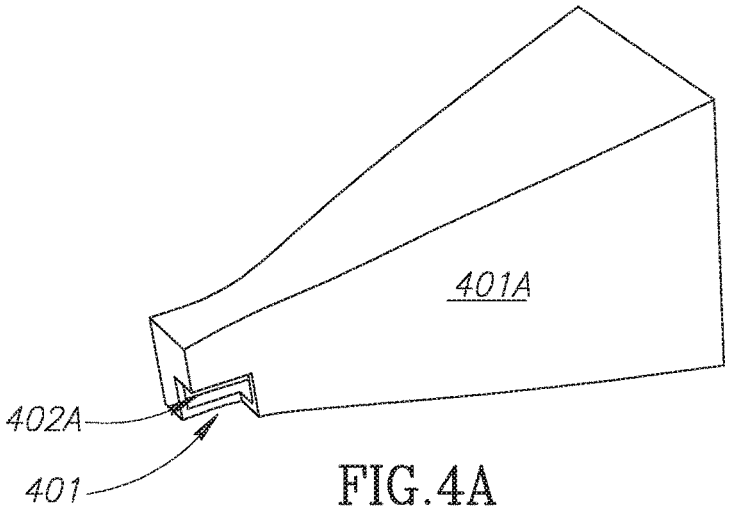
FIG. 4A is a schematic illustration of a first variation of a first waveguide for compact microwave transceiving, according to some embodiments of the present invention.

Reference is now made to FIG. 4A, which is a schematic illustration of a first variation of a waveguide 401A for compact microwave transceiving, according to some embodiments of the present invention. Waveguide 401A includes an aperture 401 at one corner of the narrow end of waveguide 401A, so that the antenna in the substrate may be located within a cavity 402A of waveguide 401A and an IC ground plane is substantially co-planar with waveguide 401A walls and cavity 402A boundary. Aperture 401 opens to cavity 402A.

Figure 4B:
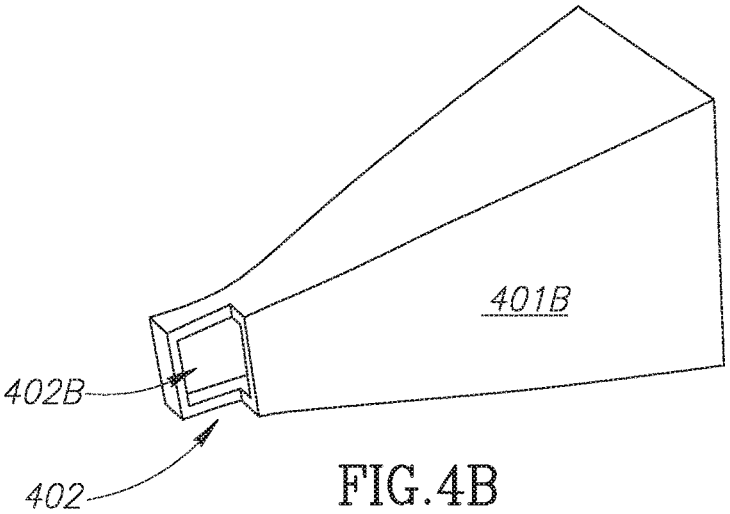
FIG. 4B is a schematic illustration of a second variation of a waveguide for compact microwave transceiving, according to some embodiments of the present invention.

Reference is now made to FIG. 4B, which is a schematic illustration of a second variation of a waveguide for compact microwave transceiving, according to some embodiments of the present invention. Waveguide 401B includes an aperture 402 at one edge of the narrow end of waveguide 401B, so that the antenna in the substrate may be located within a cavity 402B of waveguide 401B and an IC ground plane may be substantially co-planar with waveguide 401B walls and cavity 402B boundary. Aperture 402 opens to cavity 402B.

Figure 4C:
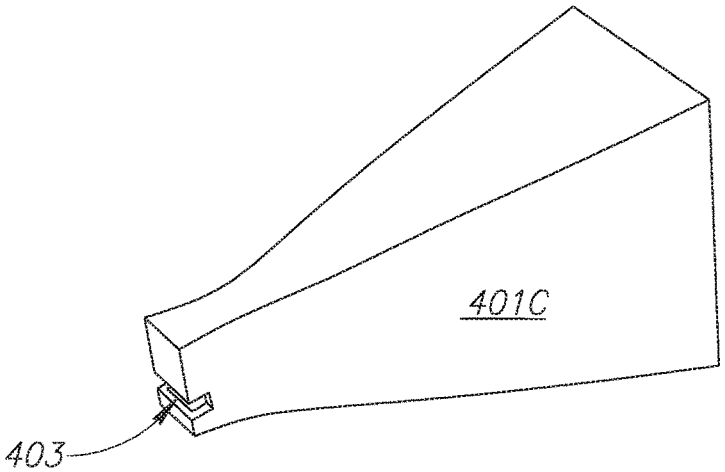
FIG. 4C is a schematic illustration of a third variation of a waveguide for compact microwave transceiving, according to some embodiments of the present invention.

Reference is now made to FIG. 4C, which is a schematic illustration of a third variation of a waveguide for compact microwave transceiving, according to some embodiments of the present invention. Waveguide 401C includes a slot aperture 403 at the narrow end of waveguide 401C, so that the antenna in the substrate may be located within a cavity (not indicated in the figure) of waveguide 401C and an IC ground plane may be substantially co-planar with waveguide 401C walls and cavity boundary (not shown). Aperture 403 opens to the cavity.

Figure 5:
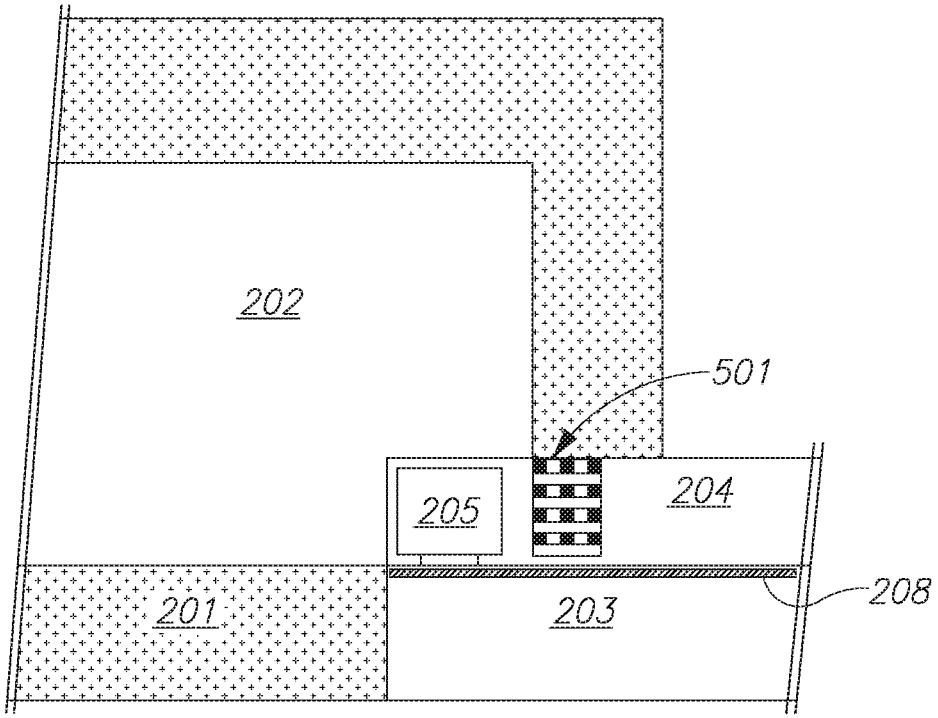
FIG. 5 is a schematic illustration of an integrated circuit and waveguide assembly with vias for compact microwave transceiving, according to some embodiments of the present invention.

Reference is now made to FIG. 5, which is a schematic illustration of an integrated circuit 203 and waveguide assembly with vias 501 for compact microwave transceiving, according to some embodiments of the present invention. As in FIG. 2, ground plane 208 is may be substantially co-planar with waveguide 201 walls, so that IC 203 components are outside cavity and antenna 205 embedded in substrate 204 may be located inside cavity 202. Optional vias 501 within substrate 204 further confining electromagnetic radiation from antenna within waveguide 201 cavity 202 to increase efficiency.

Figure 6A:
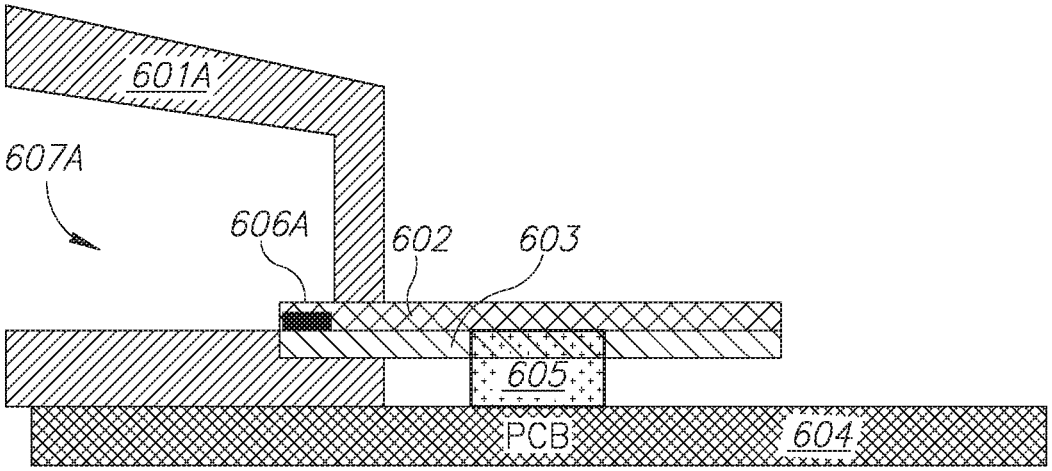
FIG. 6A is a schematic illustration of a first mounting alternative of an IC, a substrate, and a waveguide on a PCB, according to some embodiments of the present invention.
Figure 6B:
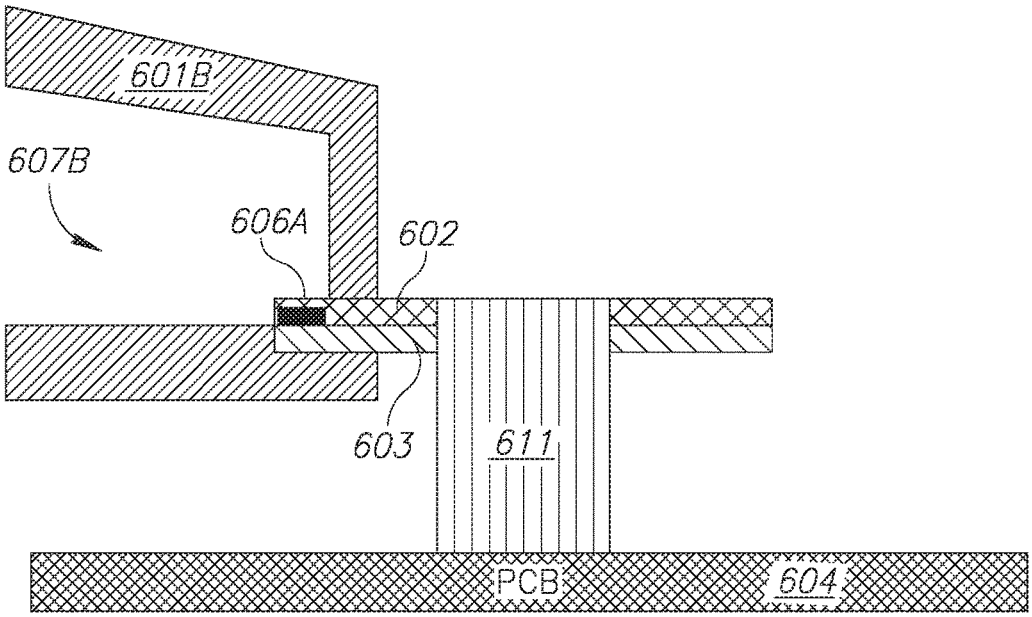
FIG. 6B is a schematic illustration of a second mounting alternative of an IC, a substrate, and a waveguide on a PCB, according to some embodiments of the present invention.
Figure 6C:
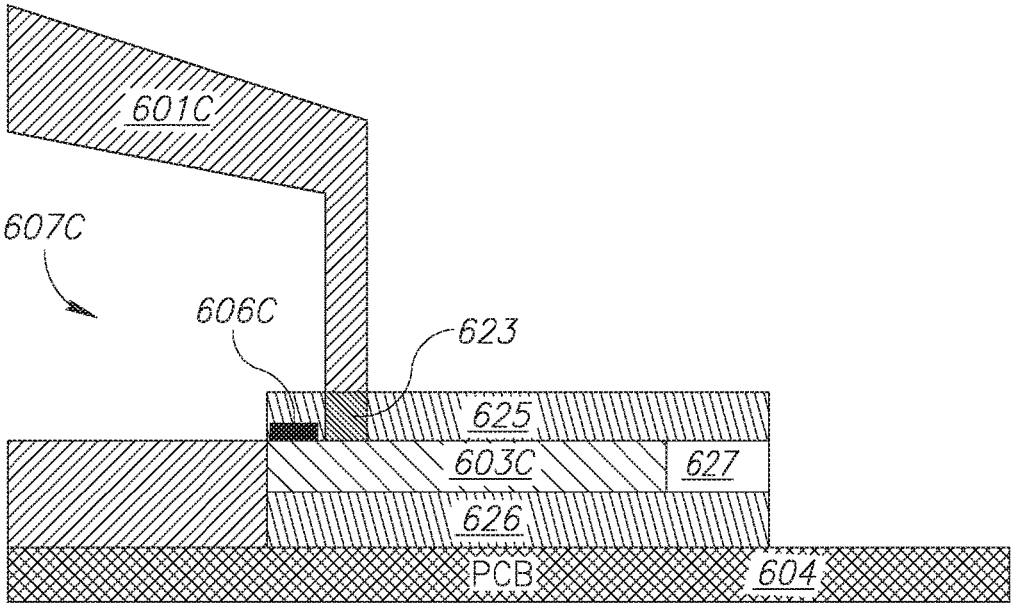
FIG. 6C is a schematic illustration of a third mounting alternative of an IC, a substrate, and a waveguide on a PCB, according to some embodiments of the present invention.

Reference is now made to FIG. 6A, FIG. 6B, and FIG. 6C, which are a first, second, and third mounting alternatives, respectively, of an IC 603, a substrate, and a waveguide 601A on a PCB 604, according to some embodiments of the present invention. As some components of FIG. 6A, FIG. 6B, and FIG. 6C are similar, the alphabetic suffix A, B, or C appended to the reference number refers to the respective of drawing of FIG. 6A, FIG. 6B, and FIG. 6C, and the following will use the suffix A for brevity. Waveguide 601A has walls surrounding an internal cavity 607A, with an aperture containing at least an antenna 606A, a substrate 602, and IC 603. Substrate 602 may be connected to a PCB 604 using a header 605 as in FIG. 6A, such as a Joint Test Action Group (JTAG) connector and the/or like, a flexible PCB 611 as in FIG. 6B, and the/or like. Alternatively, a substrate comprises two or more substrate layers as at 625, 626 and 627 in FIG. 6C with IC 603 embedded in substrate as an active embedded component, and electronic interconnections between substrate layers 625, 626 and 627, such as vias and soldering connections, electrically connect the substrate to PCB 604 directly. Optionally, vias 623 in substrate layer 625 reflect some of the electromagnetic radiation energy from antenna 606A back into cavity 607A.

Figure 7:
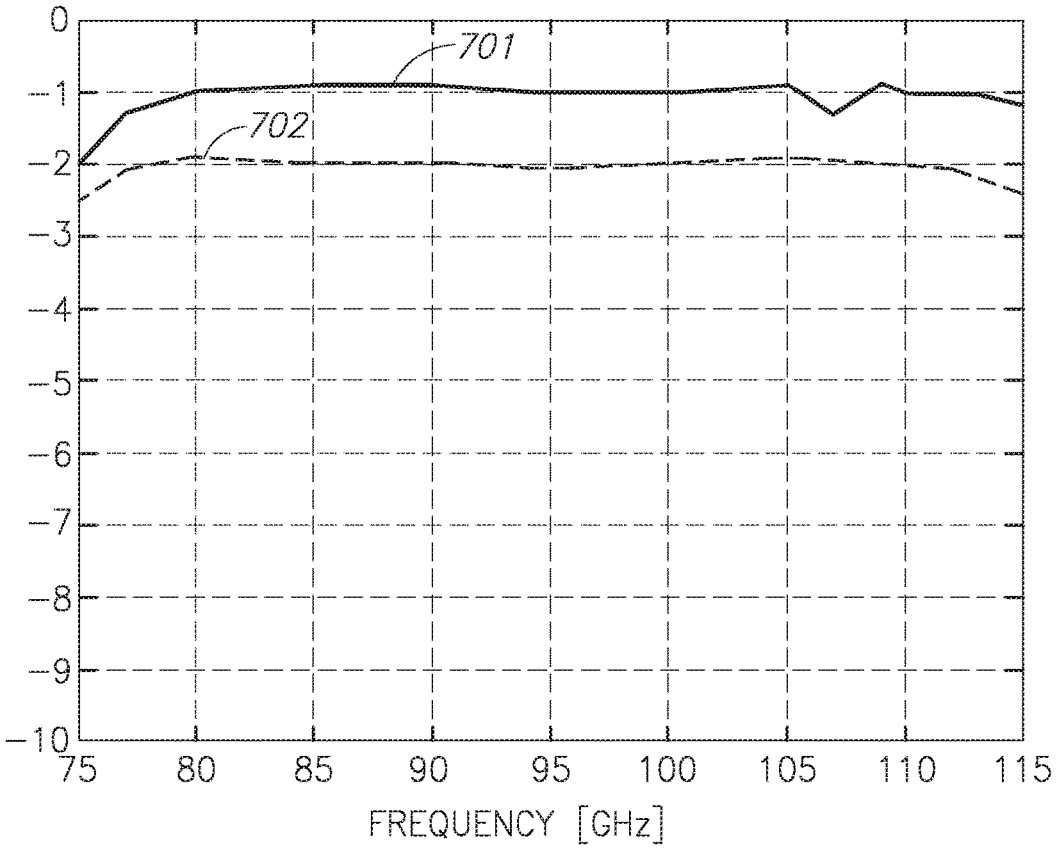
FIG. 7 is a graph of a transmission losses between an IC and a waveguide cavity, according to some embodiments of the present invention.

Reference is now made to FIG. 7, which is a graph of a transmission losses between an IC and a waveguide cavity, according to some embodiments of the present invention. The graph shows measured transmission loss (Y axis), such as signal attenuation, versus the transmission frequency of existing solution and an embodiment of the invention. Transmission losses 702 from a IC located outside the waveguide are much greater than transmission losses 701 from a IC located in an aperture of the waveguide at all frequencies, showing the benefits in reducing transmission losses when using some embodiments.

At millimeter wavelength and terahertz frequencies, such as microwave radiation, common interconnect solutions have significant connection losses between the integrated circuit (IC), transmission line (TL), and/or printed circuit board (PCB). Additionally, current solutions for chip to waveguide transitions occupy a significant amount of IC and/or PCB area and may be complicated for mass production.

Figure 8:
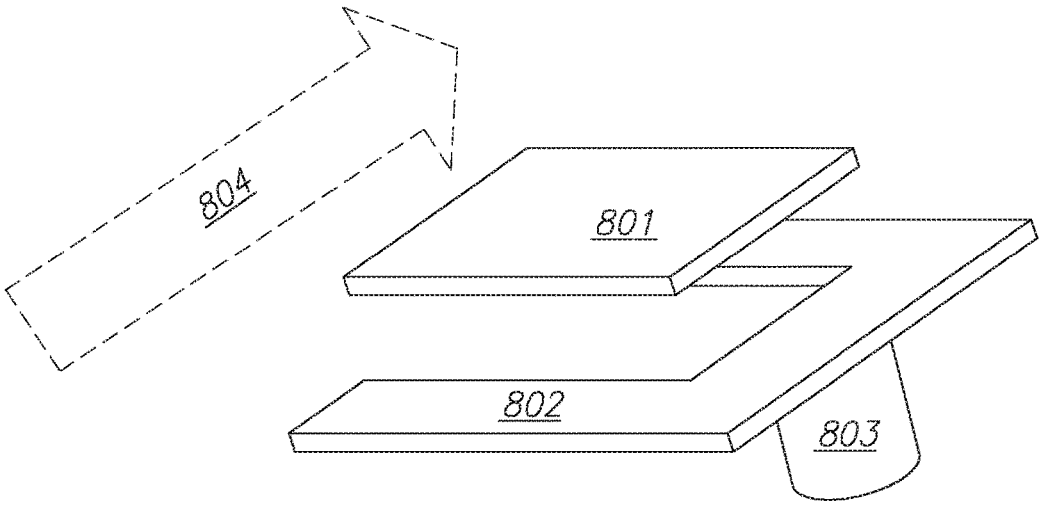
FIG. 8 is a schematic illustration of an antenna structure for microwave waveguide transceiving, according to some embodiments of the present invention.

Reference is now made to FIG. 8, which is a schematic illustration of an antenna structure for microwave waveguide transceiving, according to some embodiments of the present invention. The antenna, isolated from the substrate and IC in this illustration, comprises a floating patch 801, such as an electrically isolated conductor patch, that may be part of a metallic layer of the substrate (not shown). The antenna comprises a main slotted patch 802, such as a conductor patch electrically connected with a via 803 to an IC (not shown), that may be part of a second metallic layer of the substrate. The slot of patch 802 is directed perpendicular to the waveguide axis 804. The stacked patch conductor structure of the antenna allows greater operational bandwidth. The slot of the main slotted patch 802 reduces the anti-resonance effects of an antenna in a waveguide, such as decreased transmission losses.

A benefit of some embodiments may be the use of a conventional substrate, standard IC fabrication techniques, and a standard waveguide with minor modifications, which can be assembled by a simple process. A benefit of some embodiments may be low transmission losses as the electromagnetic energy may be channeled directly from the IC to the waveguide along a very short distance. A benefit of some embodiments may be that losses associated with an IC, such as losses from semi-conductor components of the IC, conducting components of the IC, materials of the IC, and the like, may have little effect on transmission performance and therefore standard IC fabrication processes may be used.

A benefit of some embodiments may be that the antenna on the substrate can be single ended or differential, and may be any printed structure that excites the waveguide. For example, one embodiment uses a stacked, slotted, patch antenna.

A benefit of some embodiments may be that the energy channeling mechanism from the chip to the waveguide can be galvanic, such as using solder bumps and a via, or may be non-galvanic, such as using electromagnetic coupling.

A benefit of some embodiments may be that the assembly is compact and uses a small surface area of the IC by entering the waveguide from the "B" side of the rectangular waveguide which is smaller than the "A" side. The "B" side can be further reduced in size up to 40% less than standard dimensions and still operate with low losses. In W-band frequencies, for example, the "B" side can be reduced up to 0.8 mm relative to 1.27 mm of the standard WR-10 sized waveguide, as defined by the International Electrotechnical Commission (IEC) Standard IEC 60154-1:1982 "Flanges for waveguides. Part 1: General requirements" and related IEC documents. As used herein, the terms "A" side refers to the long transverse dimension of a rectangular waveguide, and terms "B" side refers to the short transverse dimension of a rectangular waveguide.

To clarify the references in this disclosure, it is noted that the use of nouns as common nouns, proper nouns, named nouns, and the/or like is not intended to imply that embodiments of the invention are limited to a single embodiment, and many configurations of the disclosed components can be used to describe some embodiments of the invention, while other configurations may be derived from these embodiments in different configurations.

In the interest of clarity, not all of the routine features of the implementations described herein are shown and described. It should, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Based upon the teachings of this disclosure, it is expected that one of ordinary skill in the art will be readily able to practice the present invention. The descriptions of the various embodiments provided herein are believed to provide ample insight and details of the present invention to enable one of ordinary skill to practice the invention. Moreover, the various features and embodiments of the invention described above are specifically contemplated to be used alone as well as in various combinations.

Conventional and/or contemporary circuit design and layout tools may be used to implement the invention. The specific embodiments described herein, and in particular the various thicknesses and compositions of various layers, are illustrative of exemplary embodiments, and should not be viewed as limiting the invention to such specific implementation choices. Accordingly, plural instances may be provided for components described herein as a single instance.

While circuits and physical structures are generally presumed, it is well recognized that in modern semiconductor design and fabrication, physical structures and circuits may be embodied in computer readable descriptive form suitable for use in subsequent design, test or fabrication stages as well as in resultant fabricated semiconductor integrated circuits. Accordingly, claims directed to traditional circuits or structures may, consistent with particular language thereof, read upon computer readable encodings and representations of same, whether embodied in media or combined with suitable reader facilities to allow fabrication, test, or design refinement of the corresponding circuits and/or structures. Structures and functionality presented as discrete components in the exemplary configurations may be implemented as a combined structure or component. The invention is contemplated to include circuits, systems of circuits, related methods, and computer-readable medium encodings of such circuits, systems, and methods, all as described herein, and as defined in the appended claims. As used herein, a computer readable medium includes at least disk, tape, or other magnetic, optical, semiconductor (e.g., flash memory cards, ROM), or electronic medium and a network, wireline, wireless or other communications medium.

The foregoing detailed description has described only a few of the many possible implementations of the present invention. For this reason, this detailed description is intended by way of illustration, and not by way of limitations. Variations and modifications of the embodiments disclosed herein may be made based on the description set forth herein, without departing from the scope and spirit of the invention. It is only the following claims, including all equivalents, which are intended to define the scope of this invention. In particular, even though the preferred embodiments are described in the context of a PLL operating at exemplary frequencies, the teachings of the present invention are believed advantageous for use with other types of circuitry in which a circuit element, such as an inductor, may benefit from electromagnetic shielding. Moreover, the techniques described herein may also be applied to other types of circuit applications. Accordingly, other variations, modifications, additions, and improvements may fall within the scope of the invention as defined in the claims that follow.

Embodiments of the present invention may be used to fabricate, produce, and/or assemble integrated circuits and/or products based on integrated circuits.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application, or technical improvement over technologies found in the marketplace, or to enable others of ordinary skill in the art to understand the embodiments disclosed herein.

What is claimed is:

1. An assembly for electromagnetic transmission, comprising:

an electromagnetic waveguide cavity defined by waveguide walls, wherein said walls have an aperture that opens to said cavity; and a substrate assembly disposed in said aperture and including:

(a) a substrate having a ground plane and an antenna, wherein said antenna is located within said cavity and configured for transmitting or receiving electromagnetic radiation via said cavity; and (b) an integrated circuit (IC) electrically connected to said substrate, wherein said IC comprises a plurality of electronic components, wherein said ground plane is located (i) between said plurality of electronic components and said antenna, and (ii) across said aperture to confine said electromagnetic radiation to said cavity by reducing the area of said aperture.

2. The assembly of claim 1, wherein said ground plane is substantially coplanar with one of said waveguide walls.

3. The assembly of claim 1, wherein said antenna comprises:

a first transceiving conductor electrically connected to said IC, wherein said first transceiving conductor comprises at least one recess configured to decrease resonance within said cavity from electromagnetic radiation emanating from said first transceiving conductor; and a second transceiving conductor electrically isolated from said IC to increase the bandwidth of said electromagnetic radiation emanating from said first transceiving conductor.

4. The assembly of claim 3, wherein said first transceiving conductor is a C-shape slotted conductor patch.

5. The assembly of claim 3, wherein said first transceiving conductor is an E-shape slotted conductor patch.

6. The assembly of claim 1, wherein said integrated circuit is electrically connected to said substrate with a controlled collapse chip connection.

7. The assembly of claim 1, wherein said antenna comprises metallic layers embedded in said substrate.

8. The assembly of claim 1, wherein said antenna is a surface mount component electrically connected to said substrate.

9. The assembly of claim 1, wherein said substrate is electrically connected to a printed circuit board by a flexible printed circuit board.

10. The assembly of claim 1, wherein said substrate is electrically connected to a printed circuit board by a connector.

11. The assembly of claim 1, wherein said substrate is electrically connected to a printed circuit board by a direct solder connection and said IC is an active embedded component in said substrate.

12. The assembly of claim 1, wherein said substrate comprises a plurality of vias arranged across some of said aperture to further confine said electromagnetic radiation to said cavity by further reducing the area of said aperture.

13. The assembly of claim 1, wherein a ground plane of said IC is also located between said plurality of electronic components and said antenna.

14. A manufacturing method comprising:

preparing a substrate that includes a ground plane and an antenna;

attaching an integrated circuit to said substrate using a controlled collapse chip connection, wherein said IC comprises a plurality of electronic components, and said attaching positions said ground plane between said electronic components and said antenna, thereby producing a substrate assembly;

mounting said substrate assembly to an electromagnetic waveguide, such that an aperture in said waveguide receives said substrate with (i) said antenna located within a cavity of said waveguide, and (ii) said ground plane of said substrate located across said aperture to confine electromagnetic radiation to said cavity by reducing the area of said aperture.

15. The method of claim 14, wherein said mounting includes making said ground plane coplanar with at least one wall of said waveguide.

16. The method of claim 15, wherein said substrate further includes a plurality of vias, and wherein said mounting arranges the plurality of vias across some of said aperture to further confine said electromagnetic radiation to said cavity by further reducing the area of said aperture.

17. The method of claim 14, wherein said antenna comprises a first transceiving conductor electrically connected to some of said plurality of electronic components using a via of said substrate; and a second transceiving conductor electrically isolated from said plurality of electronic components.

18. The method of claim 14, wherein said attaching also positions a ground plane of said IC between said plurality of electronic components and said antenna.

* * * * *